US006113309A

United States Patent [19]

Hollon et al.

[11] Patent Number: 6,113,309

[45] Date of Patent: Sep. 5, 2000

[54] UNIFORM COMPACTION OF ASPHALT CONCRETE

[76] Inventors: Edmund D. Hollon, 130 Frontier Dr.; Blake D. Hollon, 1941 Park Dr., both of Douglas, Wyo. 82633

[21] Appl. No.: 08/908,551

[22] Filed: Aug. 8, 1997

Related U.S. Application Data

[60] Provisional application No. 60/024,241, Aug. 20, 1996.

[51] Int. Cl.[7] ..... E01C 23/01

[52] U.S. Cl. ..... 404/84.5; 404/96; 404/122; 180/20

[58] Field of Search ..... 404/72, 75, 84; 94/46 R; 364/513; 180/20

[56] References Cited

U.S. PATENT DOCUMENTS

| | | | |
|---|---|---|---|
| 3,638,540 | 2/1972 | Williams | 94/46 |
| 3,844,669 | 10/1974 | Eigenmann | 404/92 |
| 3,856,425 | 12/1974 | Miller et al. | 404/84 |
| 3,914,064 | 10/1975 | Gurries | 404/84 |
| 3,966,345 | 6/1976 | Kofel | 404/126 |
| 4,941,106 | 7/1990 | Krieger | 364/513 |
| 5,336,019 | 8/1994 | Hollon et al. | 404/72 |
| 5,507,593 | 4/1996 | Hollon et al. | 404/122 |
| 5,525,998 | 6/1996 | Geier | 342/357 |
| 5,546,123 | 8/1996 | Ikeda et al. | 404/84.5 |

FOREIGN PATENT DOCUMENTS

| | | | |
|---|---|---|---|
| 2061966 | 6/1972 | Germany | 19/22 |
| 2119332 | 12/1982 | Germany | 19/22 |

*Primary Examiner*—Eileen Dunn Lillis
*Assistant Examiner*—Raymond W Addie
*Attorney, Agent, or Firm*—Dean P. Edmundson

[57] ABSTRACT

Methods are disclosed for controlling the steering of a carrier vehicle having a horizontal compacting roller and a side edge confinement roller or shoe for compacting an asphalt concrete lane. In one embodiment, a sensor is on the carrier vehicle for sensing the position of a defined edge of the lane, and a control is provided for steering the carrier vehicle so that the horizontal roller and the edge confinement force roller or shoe follow the defined edge of the lane to provide uniform density. A method is also provided for controlling the compacting force of a horizontal compacting roller carried by a carrier vehicle.

25 Claims, 11 Drawing Sheets

POSSIBLE PATHS OF CONNECTION IN FIGURE 3:

MANUAL:

301B → 302 → 305

AUTOMATIC:

301A → 303A → 304

301C → 303C → 304

301B → 302 → 303B → 304

301A → 303C → 304

301B → 303C → 304

FIGURE 3A

PATHS OF CONNECTION IN FIGURE 4:

PAVER SYSTEM PATH:

401A+ 401B=402A; 402A → 403 → 404

TRANSMISSION PATH: (BETWEEN PAVER & EDGE ROLLER)

404 → 410 → 405

MANUAL DATA TRANSFER PATH: (BETWEEN PAVER & EDGE ROLLER)

403 → 409 → 406

EDGE ROLLER SYSTEM PATH:

401A+401B=402B; 402B+405 → 406; 406 → 407A & 407B

FIGURE 4A

UNIFORM COMPACTION OF ASPHALT CONCRETE

CROSS-REFERENCE TO RELATED APPLICATION

This application is based upon, and claims priority from, our copending provisional application No. 60/024,241, filed Aug. 20, 1996, incorporated herein by reference.

FIELD OF THE INVENTION

This invention relates to compaction of asphalt concrete. More particularly, this invention relates to means for obtaining uniform compaction of asphalt concrete to reduce or prevent cracking of the asphalt concrete surface. In another aspect, this invention provides apparatus for use in obtaining uniform compaction of asphalt concrete.

BACKGROUND OF THE INVENTION

Our earlier patents, U.S. Pat. No. 5,336,019 and U.S. Pat. No. 5,507,593, describe method and apparatus for obtaining uniform compaction of asphalt concrete, which patents are incorporated herein by reference.

SUMMARY OF THE INVENTION

In accordance with the present invention there is provided improved techniques and apparatus for controlling the functions of: 1) positioning of the edge confinement roller, and 2) carrier vehicle steering.

Other advantages of the method and apparatus of this invention will be apparent from the following detailed description and the accompanying drawings.

BRIEF DESCRIPTION OF THE DRAWINGS

The invention is described in more detail herein after with reference to the accompanying drawings, wherein like reference characters refer to the same parts throughout the several views and in which:

FIG. 3A is a table showing the different possible pathways in FIG. 3 for controlling the steering of the compacting apparatus.

FIG. 4A is a table showing the different possible pathways in FIG. 4 for controlling steering, and the position of the edge confinement roller.

DETAILED DESCRIPTION OF INVENTION

Figure 1:
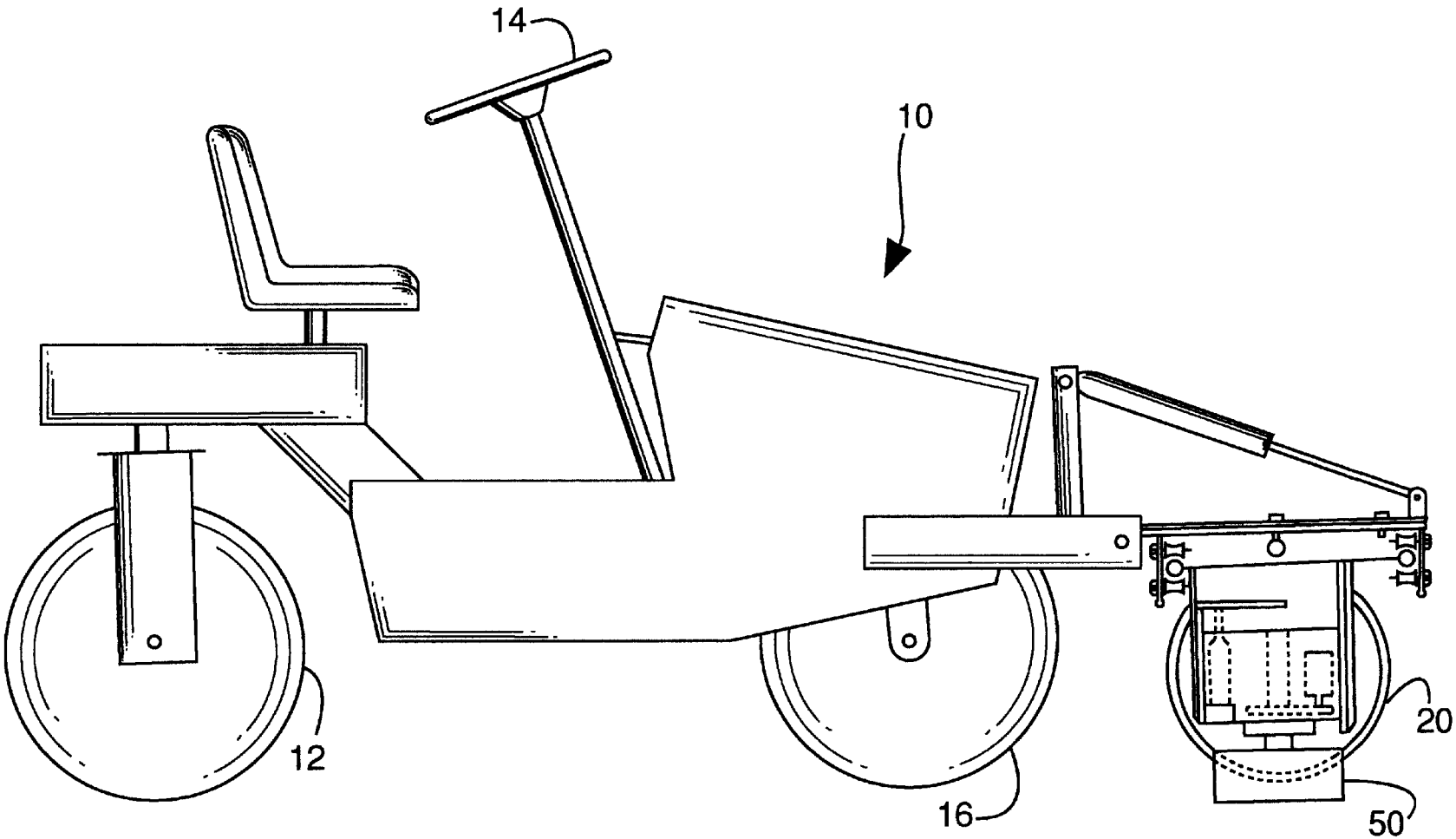
FIGURE 1 (PRIOR ART)
FIG. 1 is a side elevation of asphalt concrete compacting apparatus as described in our prior apparatus patent, U.S. Pat. No. 5,507,593, incorporated herein by reference.

The apparatus patent, U.S. Pat. No. 5,507,593, describes a machine which will perform the intended function of our prior patents. While working in this area with the controls as set out in the patents, we have come up with improved ways to control the substantially vertical edge confinement roller 250 pressure and horizontal roller 220 down pressure and/or the elevation of horizontal roller 220 in relation to the elevation and the plane of the compacted surface of the entire width of the mat. The term "substantially vertical" refers to the edge confinement roller 250 being at an angle not greater that 45° away from a vertical line. In reality, this will put the finished compacted surface under the horizontal roller of the apparatus, in the exact same plane as the compacted surface of the entire paver pass width. The apparatus horizontal roller 220 (not carrier rollers 212A, 212B & 213), mounted in its frame, is raised and lowered by machine screws or ball screws on each side of the vehicle. These screws are operated, either up or down, by hydraulic, pneumatic or electric motors. Other means may be used for raising and lowering horizontal roller 220. The mat is previously rolled by conventional asphalt rollers to within 8 to 12 inches, more or less, of the unconfined edge, this depending partially on the length of apparatus horizontal roller 220 which will be used to compact this side edge portion. Sensors 501 will read the elevation and the plane of the compacted surface, and will tell the hydraulic motors 408 on the screws to go up or down to match the compacted plane of apparatus horizontal roller 220 with the plane of the finished surface rolled by conventional rollers. In other words, the sensors will control the height of the bottom of horizontal roller 220, stopping when a predetermined down pressure is reached. Edge confinement roller 250 can have a load cell to tell the operator how much side force is being applied and the operator can adjust this side force to the amount of pressure needed to contain the edge so horizontal roller 220 is able to compact this 8 to 12 inches, more or less, is in the same plane as the plane of the balance of the paver pass width.

To relieve the machine operator of the task of steering the apparatus carrier, we have conceived of techniques for the carrier to steer itself. This would free up the operator to spend more time making sure the edge was being properly compacted to the desired density. There are many ways this automatic guidance system could be accomplished.

The first and rather simple self steering system would simply have the carrier steer itself a given distance or a range of distances, 1" to 3" or 1' or 3', etc., from the finished edge that the apparatus side roller has or is finishing on the edge of the mat. In this mode, the operator selects the desired pressure, as measured by the load cell, to confine the edge to achieve the proper edge density.

The second, but somewhat more complicated, way of guiding the carrier would be for the steering system to follow a guidance marker for a sensor to follow. The marker would be laid by the asphalt paver. The modern asphalt pavers have heated extendable screeds so as to be able to lay the hot mix asphalt edge to a given line. On some machines this edge width adjustment is done manually and some have electronic capabilities to follow a string line. This edge width will hold a line within plus or minus one inch. For our purpose, plus or minus means nothing as we are going to finish the edge wherever it is laid. The paver lays down the amount of hot mix asphalt to do the width that the paver is set at. An attachment would be affixed to the paver screed that would place a marker in or on the partially compacted hot mix behind the paver screed or to the side of the paver onto the substrate that the hot mix is being placed on. This marker would be located in reference to the end or ends of the extendable screeds. These markers could be wires, paint, metal particles, or any other material that a sensor could follow.

Some of the sensors useful for following the different kinds of markers could be photoelectric, infrared, laser, fiberoptics, magnetic and others. You could also use electronic cameras. It could be one of many kinds of electronic cameras. This camera could show a stationary pointer which would be kept over one of the different types of marker lines. This picture or image then would be shown on a remote screen or monitor. There it could be viewed by the operator and the operator could then keep the stationary pointer in line with the marker to manually steer the roller carrier on the desired course. This electronic camera system could also be used to automatically steer the roller carrier. This is all known technology.

From this you use an electric control that would steer left or right from less than ⅛ inch to a foot or more that a given point on the carrier would stay within these limits. This electronic sensor equipment is known technology. This system solves many of the problems that the operator has to make adjustments for. These problems come mostly from the temperature changes of the hot mix asphalt and the hot mix asphalt at the moment it is being compacted. In this system the apparatus is confining the given amount of hot mix asphalt in a given space and this will give you the density you desire. This allows a given amount of air void in this given space and this is exactly what is meant by density.

It seemed logical to have all the apparatus powered with hydraulics. For the side shift of the apparatus roller, we change to air. The hydraulics worked, but the movements were rather harsh while the air movements are smoother.

The carrier 10 as shown in attached FIG. 1, hereinafter called carrier, including horizontal roller 20 and substantially vertical edge confinement roller 50, shown in the reference patents will work, but we have devised a better carrier. The rear roller 12 in the patents is steerable, but the powered roller 16 is not steerable. This makes it necessary to oversteer roller 12 to the right to make roller 16 move to the left. This makes apparatus horizontal roller 20 want to move radically first to the left and then radically to the right, which it can do, just to make one correction of the roller 16.

What we are doing in the present invention is to make the rollers at both ends of the carrier steerable. This allows the carrier to steer on the lead end of the carrier, regardless of the direction the carrier is traveling. This prevents this whiplash effect of the carrier. It makes it possible for the carrier, if steered on both ends at the same time and in the same direction, to move at an oblique (slant) angle with the longitudinal centerline of the carrier remaining parallel to the longitudinal edge of the asphalt mat while moving toward or away from the asphalt longitudinal edge. This basic apparatus is shown in FIG. 2A, FIG. 2B, & FIG. 2C.

The rear roller 12, because it is steerable, is split and is actually two rollers (212A & 212B) mounted separately on a single common axle shaft. This makes them more like wide wheels. When you turn the steering wheel 14, when the carrier 10 is standing still, one half of the roller 12 is rotating in one direction and the other half is rotating in the opposite direction. When roller 16 of the previous machine becomes steerable, it will also have to be split (as shown in FIG. 2A, FIG. 2B, & FIG. 2C as 212A, 212B & 213). As a matter of weight and balance, it will be an advantage to separate the drum halves and mount them as separate wheels as shown. The widths and diameters may or may not be the same for each wheel. In addition, you can also then make it not only four-wheel steer, but also four-wheel drive. Under certain conditions, this is a great advantage.

Figure 2A:
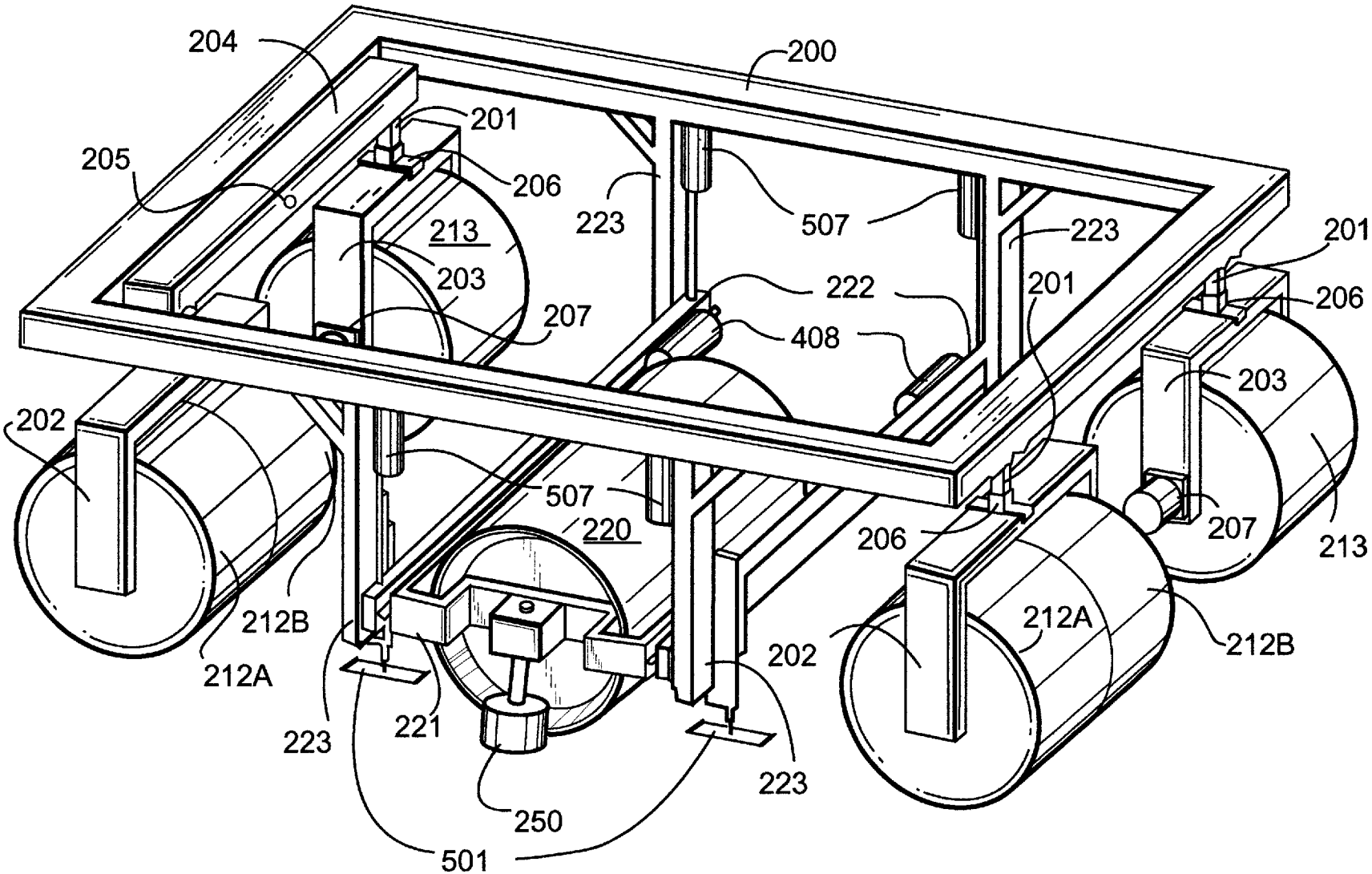
FIG. 2A is a 3-dimentional view of the roller apparatus employing principles of this invention. The view includes the rigid frame, compacting rollers, & components.
Figure 2B:
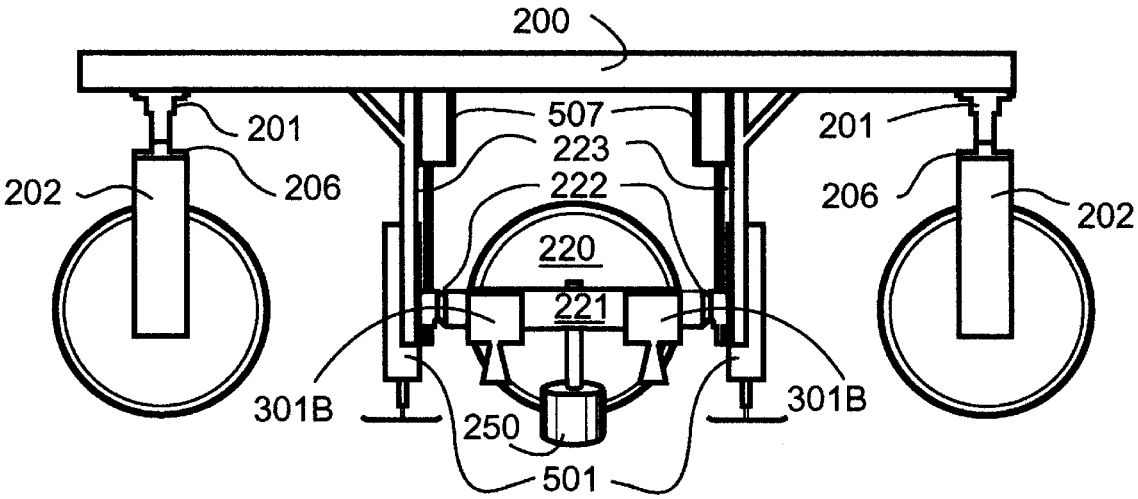
FIG. 2B is a side elevation of the roller apparatus employing principles of this invention.
Figure 2C:
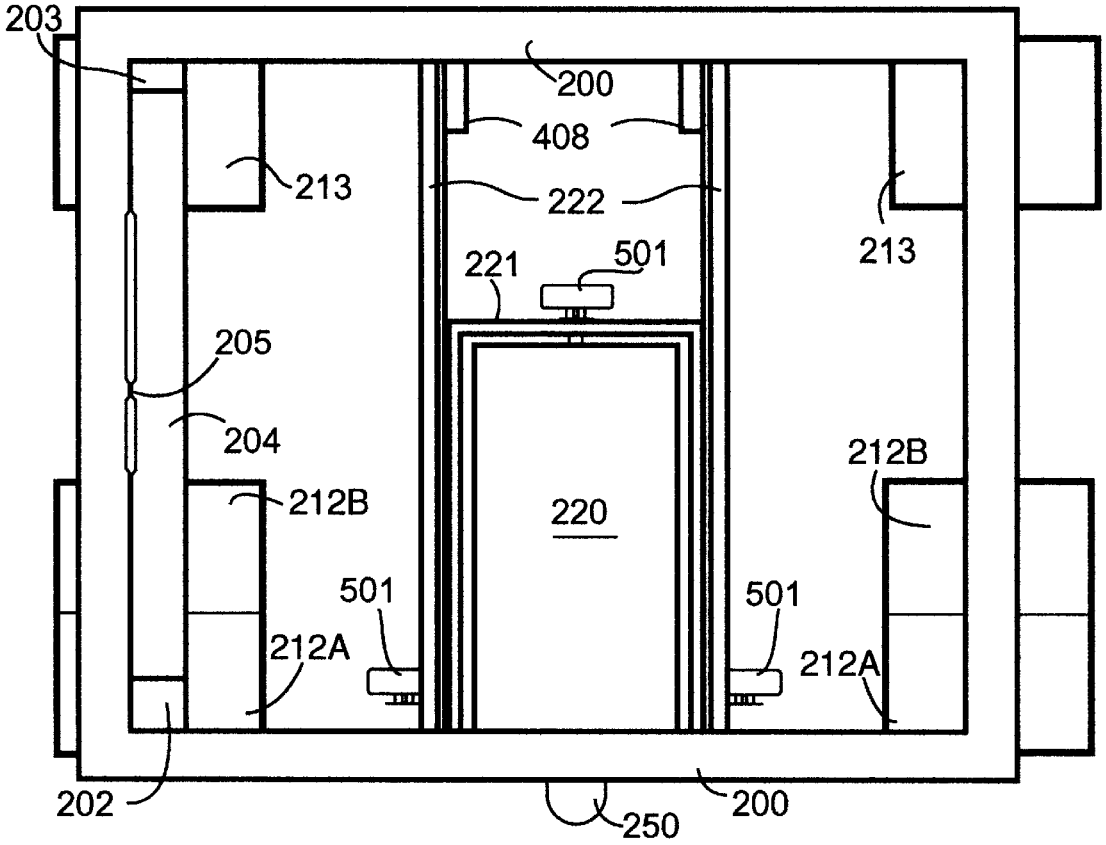
FIG. 2C is a top elevation of the roller apparatus employing principles of this invention.

In FIG. 2A, FIG. 2B, & FIG. 2C, the components shown are identified as follows:

| | |
|---|---|
| Rigid Frame | 200 |
| Yoke Pivots | 201 |
| Yokes | 202 & 203 |
| Bolster | 204 |
| Bolster Pin | 205 |
| Yoke Pins | 206 |
| Wheel Motors | 207 |
| Wheels | 212A & 212B |
| Wheels | 213 |
| Horizontal Roller | 220 |
| Frame for Roller 220 | 221 |
| Side Shift Guide for Roller 220 | 222 |
| Vertical Guide for Roller 220 | 223 |
| Edge Confinement Roller | 250 |
| Side Shift Ball Screws w/motors for Roller 220 | 408 |
| Proximity Sensor Units | 501 |
| Vertical Ball Screws w/motors for Roller 220 | 508 |

The rigid frame 200 divides this machine into two distinct areas. Everything below this frame is the functional part of the machine. This part does what the basic intent of the machine is all about. That is to confine and compact the edge of material, that the paver has laid down, to the same consistent desired density of the balance of the paver width.

Everything above this frame is just service for what is below the frame. This area has the mechanism to furnish the different power systems, such as hydraulic and pneumatic systems, electricity, the electronic control systems, the steering and guidance systems, sensors to monitor and control the functioning of the apparatus below this rigid frame 200. How all of these services are carried out is really superfluous as they can be done in many ways using known technology.

The apparatus roller 220 could remain on either end of the carrier, but if it were placed mid-ship between the front and rear rollers, as shown in FIG. 2A, FIG. 2B, & FIG. 2C, it will have great advantages when driving the machine in either direction.

In controlling the weight and balance, to the best advantage, ballast tanks may be placed on either end of the carrier beyond the wheel rollers of the carrier. Also in between the steel rollers would be another logical location for ballast tanks as well as mid-ship with the apparatus. All these tanks could have more than one compartment to help shift weight from side to side and end to end to the best advantage.

The wheel rollers could also be so constructed to receive ballast fluids. All of this fluid ballast could be so plumbed that it could be drained, blown, pumped, or shifted in any other manner, from one area to another or discharged from the machine if conditions were to change. Such changes as grade, slope, gradation of the hot mix asphalt, grade of the asphalt binders, polymer modified binders used now or in the future or many other condition changes.

These wheels can very well be just bare metal as the regular asphalt rollers or they may have a solid tire of some material such as ultra-high molecular weight polyethylene or other plastic or rubber blends. These tires could also be of some other design such as pneumatic, semi-pneumatic, or filled with some material to stabilize the tire surface when under heat and/or stress. These are all known technologies.

In our two reference patents cited at the beginning of this disclosure, the problem of the longitudinal paver joint is covered in great detail. In the above body of this disclosure we explain a new invention for a better apparatus to do this job in the same manner as our apparatus patent, but in a more effective and more foolproof manner. The two systems of having the machine steer itself lead us to another way of doing the same thing in a different manner.

Using the second system of self steering, a machine employs a sensor to follow a guidance marker in or alongside a course of asphalt concrete.

In the apparatus patent, U.S. Pat. No. 5,507,593, column three and staring with line seventeen and continuing through line thirty-five, we tell of two roller manufacturers who each have an edge confinement roller attached hard and fast to one of the two rollers on their brand of machine. These edge confinement rollers are very similar to each other and function in the same manner. One brand is a Bomag and one is a Hamm.

The Bomag and Hamm edge confinement rollers do not include any means permitting lateral adjustment thereof Further, neither the Bomag nor Hamm apparatus include means for adjusting the pressure exerted on the edge of an asphalt lift by their edge confinement roller.

It is a common understanding in the asphalt paving construction industry that the compaction along the unconfined edge of the mat rarely reaches 90 percent compaction when traditional compaction methods are used. This is the problem. Bomag says when their edge confinement roller was used compaction averaged 95 percent. Average is the key word here and this says the problem was not solved but changed. "Average" means that the compaction, of the paver joint, could be as low as ever in some areas and much higher in other areas. The low compaction areas will still ravel and break down as always, but the overcompacted areas (over 95%) will get wide thermal cracks. This undercompaction and overcompaction is covered in the text of our method patent, U.S. Pat. No. 5,336,019, column 2 lines 15 through 36.

For airport projects, the Federal Aviation Administration now considers compacted pavement air voids so important that it will penalize contractors for too many voids (undercompaction) or too few voids (overcompaction).

By driving the compacting apparatus on an exact line, as our invention describes, you would not have these over and under edge density areas. Rather, you obtain truly uniform density of the compacted surface.

Here again, the electronic control as described in this invention will guide the roller from the guidance marker to within less than ⅛" steering either left or right. This could be either the fully automatic steering system or the system which makes it possible for an operator to guide the roller to within as little as ⅛" of the desired course. Here again, this system is confining the given amount of hot mix asphalt in a given space and this will give you the density you desire. This allows a given amount of air voids in this given space and this is exactly what is meant by desired density. The operator can make final fine adjustments to the vehicle guidance system, if need be, to correct for the desired density.

An edge confinement roller which is mounted to the carrier vehicle without any lateral adjustment capability in relation to the roller it is attached to, will be in the correct location on the asphalt edge, only because of this steering system provided by the present invention.

This edge confinement roller does not have to be in the same configuration or angle or size as either the Bomag or Hamm edge confinement roller. The edge confinement roller could have a water spray system if asphalt sticks to this roller. This edge confinement roller could be power driven rather than surface friction driven. It does not have to be a roller confinement edge but one of the other confinement types mentioned in our reference patents (e.g., a shoe or plate).

There are other ways to make it possible for the above mentioned equipment to be self steering in addition to those already outlined. In lieu of having a marker to follow, it would be possible to actually measure the amount of material that is in the last 12 inches, more or less, and determine where the exact edge of the compacted mat should be when this given amount of material is compacted in this area to reach the desired density.

The material in this last 12 inches, more or less, will not have a well defined edge or a well defined surface. This area would be immediately in front of the confinement edge compaction apparatus, would be surveyed or profiled with a laser beam, and these readings fed into an onboard computer which would be programmed so as to take these readings and extrapolate where this confinement edge apparatus should be to get the correct compaction desired. These laser readings could be taken as often as necessary. This could be for less than one second to thousands per second. This is existing off-the-shelf hardware, but this is a new use for this hardware.

Directly behind the edge confinement apparatus, if you so wished, you could have a nuclear constant density gauge to fine tune the apparatus setting.

Figure 3:
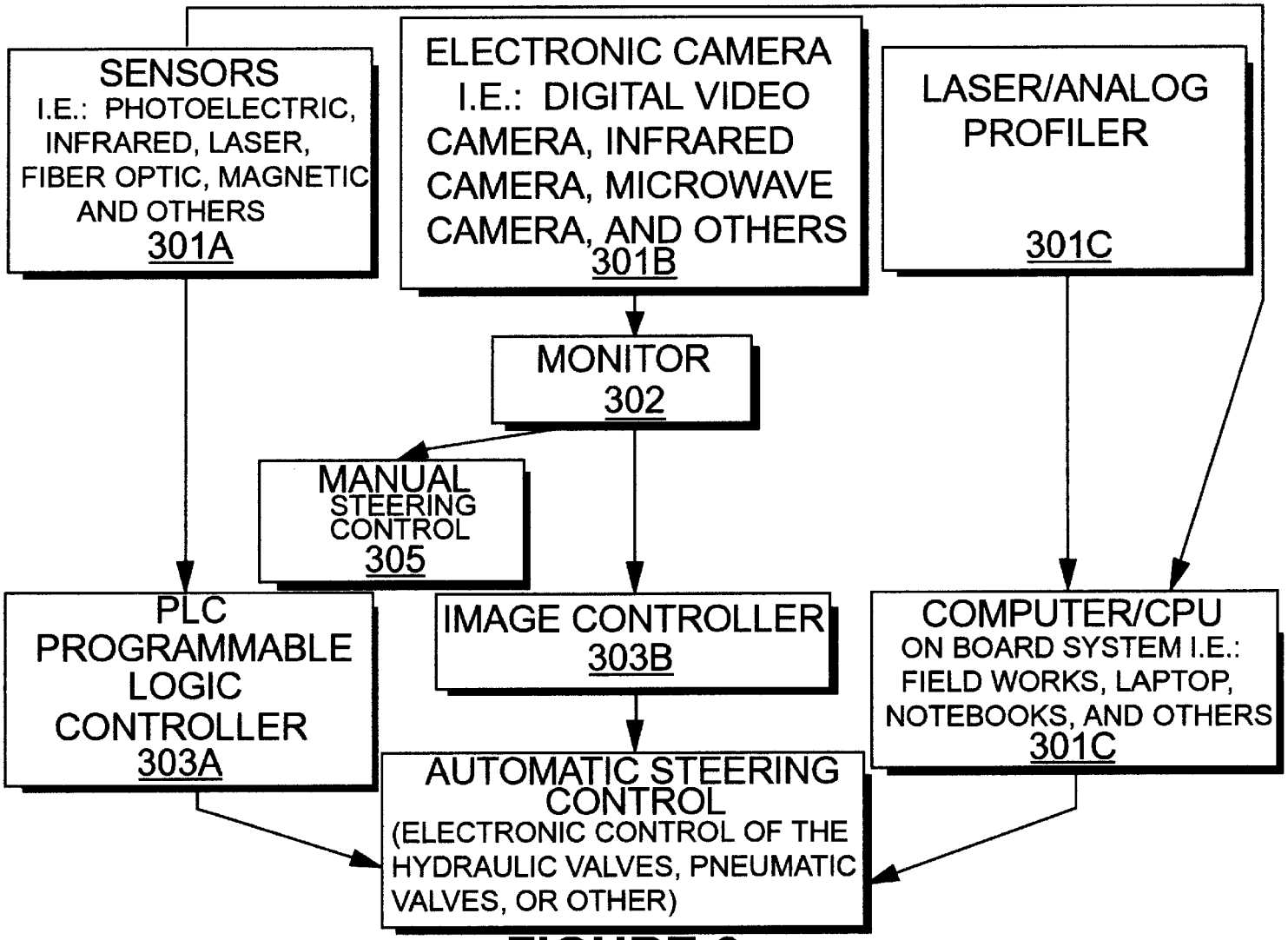
FIG. 3 is a schematic illustrating different manners in which compacting apparatus of this invention can be steered. One manner involves using an electronic camera to observe a marker or line on or adjacent to the roadway, and the machine operator observes a monitor and manually steers the machine so that a marker on the monitor follows the line or marker on the ground. Other manners involve the use of sensors to detect a line or marker on the ground and automatically control the steering of the machine. Yet another manner involves a laser/analog profiler which observes the edge profile of an uncompacted asphalt concrete layer, feeds the profile information to a computer, and uses the computer to control the steering of the machine.

FIG. 3 illustrates, in flowchart form, the different possible means of steering of the carrier vehicle. It shows the use of sensors 301A or cameras 301B, in conjunction with programmable logic controllers (PLC) 303A, such as the KV series, commercially available from 'Keyence Corporation of America'; image controllers 303B, such as the CV series, commercially available from 'Keyence Corporation of America'; or Computer/CPU 303C. These combinations are used to automatically control steering of the carrier by the electronic control of hydraulic or pneumatic valves, or to enhance manual steering.

Computer/CPU 303C can be full portable systems, such as 'Field Works' PC's, notebooks, and others, or single chip CPU's programmed for specific applications.

Sensors 301A can be used with guidance markers located in reference to the end or ends of the paver screed. These guidance markers can be the same ones used by the paver to position the end or ends of the paver screed. These guidance markers can be ones currently used for electronic paver screed control, such as wires. The markers could also be paint, metal particles, or any other material that a sensor could follow.

The sensors 301A themselves can be: photoelectric, such as the PK series, commercially available from 'Keyence Corporation of America'; infrared, such as the Line Tracer 11 Robot (This unit has been commercially available at least as early as 1984) or Memocon Crawler (w/a parallel interface), both available from 'Stock Model Parts'; laser, such as the LG series; and fiberoptic, such as the FS-L series, both commercially available from 'Keyence Corporation of America'; magnetic, such as the BMF series; and ultrasonic, such as the BUS series, both commercially available from 'Balluff, Inc.'

The Line Tracer II and Memocon Crawler, available from 'Stock Motel Parts', are both self contained units. They both contain infrared sensor pick-ups, a central processing unit (CPU), and motors and wheels for mobility. For either unit to function, a line of contrasting color on the surface the unit is to be used is needed, such as a dark line on a light colored surface or light colored line on a dark surface. Either unit is positioned over the line as to have the infrared sensors placed on each side of the line. As the unit moves, each infrared sensor will signal the CPU upon detection of the line. The CPU will then make the appropriate coarse correction as to keep the line, be it straight or curved, between the two sensors. These units are built as toy robotics, but the steering mechanics can also be applied to our use.

Sensors 301A are connected to Programmable Logic Controller 303A or Computer/CPU 303C. PLC 303A or Computer/CPU 303C can be programmed so as to perform any output response to the input signals as you wish. In the present application, we shall program PLC 502 as follows: Right limit Output ON, in response to Right limit Input sensor trigger. Left limit Output ON, in response to Left limit Input sensor trigger.

The outputs of the PLC 303A or Computer/CPU 303C are connected to electronic hydraulic or pneumatic valves, or other systems, to activate the appropriate solenoid for automatic steering control 304.

Electronic cameras 301B, such as existing digital, infrared, or microwave cameras monitor either a guidance marker or the edge of asphalt along the path of travel. See FIG. 2B. The images are sent to Image controller 303B for processing with controller outputs connected to electronic hydraulic or pneumatic valves, or other systems, to activate the appropriate solenoid for automatic steering control 304. Optical measurement systems are presently available that accomplish this task, and new ones are being introduced, such as the Single-Camera Stereometric Laser Ranging System, which uses a laser beam in conjunction with an optical camera for distance measurement.

A much simpler use for electronic cameras would be as follows: Electronic camera 301B monitor either a guidance marker or the edge of asphalt along the path of travel. The image is displayed on monitor 302 with the carrier vehicle operator uses the display to make corrections for manual steering control 305.

Figure 3B:
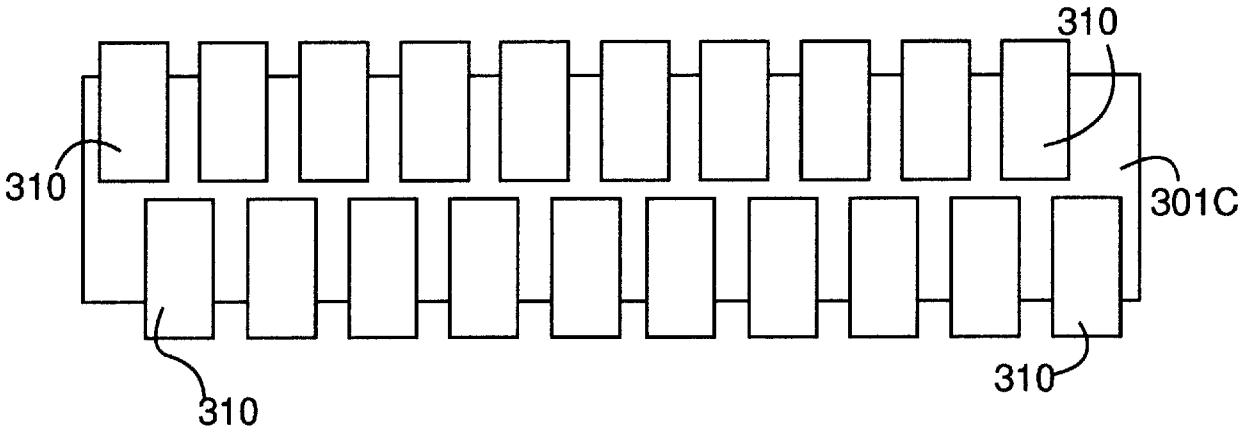
FIG. 3B is a bottom view of the laser/analog profiler.
Figure 3C:
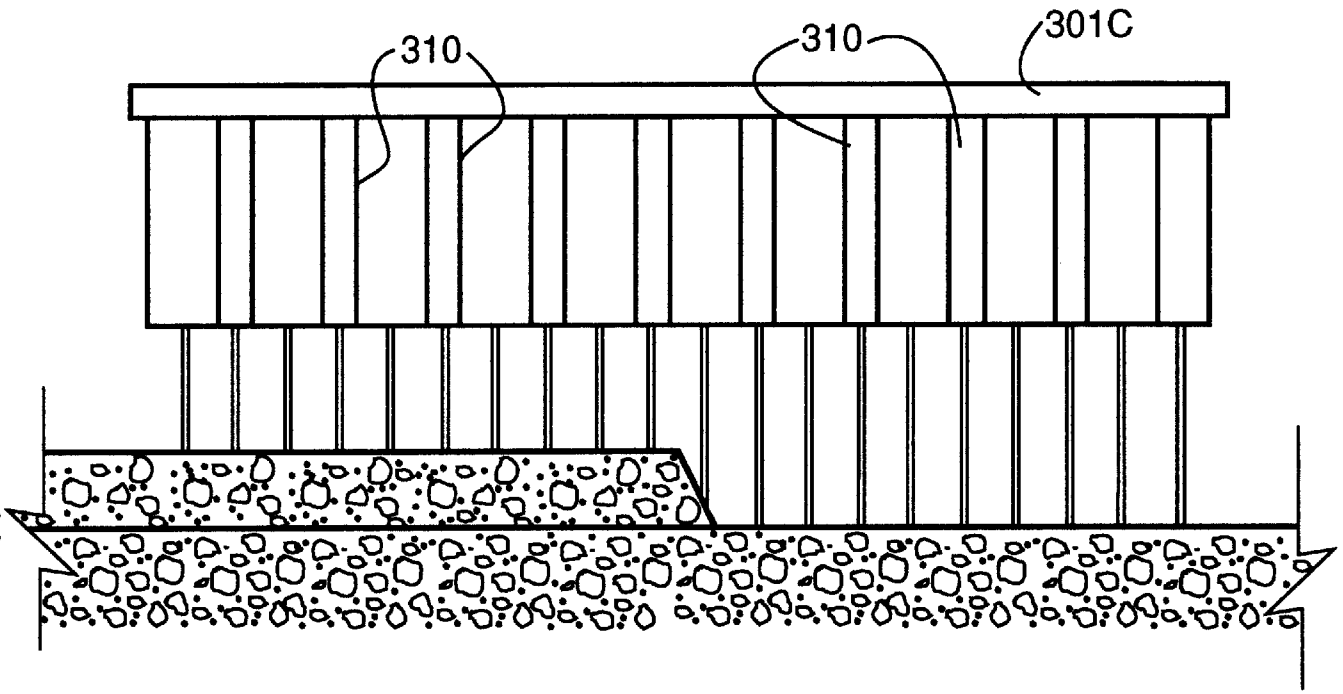
FIG. 3C is a front elevation of the laser/analog profiler.

A Laser/Analog Profiler 301C, FIG. 3B & FIG. 3C, is positioned at a fixed point on the carrier vehicle and used to ascertain the edge of the asphalt pass. The profiler consist of an array of lasers. Each laser 310 measures the distance between itself and the asphalt surface directly below. Each distances measurement is plotted on Computer/CPU 303C. The plots are connected together to produce a profile. Computer/CPU 303C uses the information to determine the point at which the planarity of the profile changes. This point would indicate the defined edge of the asphalt pass.

Outputs from Computer/CPU 303C are connected to electronic hydraulic or pneumatic valves, or other systems, to activate the appropriate solenoid for automatic steering control 304. These outputs would be programmed so as to steer the carrier vehicle in order to keep the change in planarity in the center of the profile.

Figure 4:
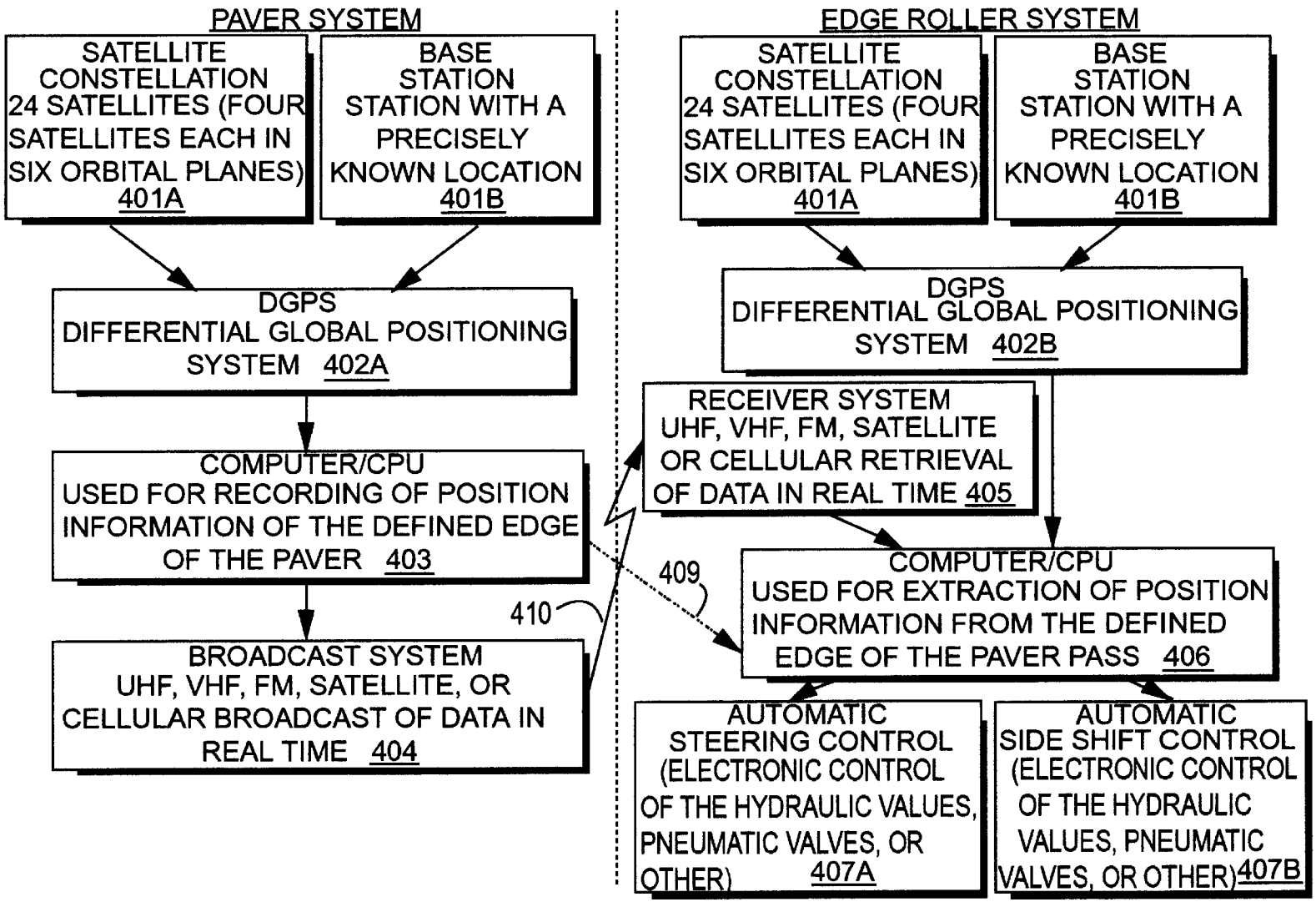
FIG. 4 is a schematic illustration of a control system using GPS (Global Positioning System) for steering the compacting apparatus of this invention, plus, for controlling the position of the edge confinement roller (or other confinement device) when compacting asphalt concrete.

FIG. 4 illustrates, in flowchart form, another possible means of steering of the carrier vehicle. This system incorporates the Global Positioning System (GPS) for Automatic Steering Control 407A and Automatic Side Shift Control 407B.

The principles of GPS are fairly simple to understand. The United States Department of Defense developed and launched a constellation of 24 GPS satellites (four satellites each in six orbital planes). This constellation was strategically placed around the earth in order to give each area of the earth's surface constant coverage by at least four different satellites. The satellites circle the earth approximately every 12 hours, with each one transmitting its own unique signal down to the GPS receiver. The receivers accept signals from as many satellites as possible, while the numbers vary depending on the receiver's location on earth. The GPS receiver, by using the signals from each satellite, can determine the distance to it.

This information is used to determine the receiver's location on earth in relation to the known points of the identified satellites. Two-dimensional positions (longitude and latitude) use the signals from three satellites, and three-dimensional positions (longitude, latitude, and elevation) require the use of four positions in fact, some of the more advanced GPS units can determine a location within one centimeter's margin of error.

Moving and precision applications, such as vehicle guidance, requires another form of GPS called Differential GPS (DGPS). This system configuration requires a base station with a precisely known location in relation to the edge of the asphalt mat to be compacted. The base station calculates its GPS position from the satellite signals, compares it with its known position, and generates correction data.

The Satellite Constellation 401A, when used with a Base Station 401B, results in a Differential Global Positioning System 402A and 402B, such as the 7400Dsi, commercially available from 'Trimble Navigation Limited'.

DGPS receiver 402A, is positioned on the paver in a location as to indicate the intended finished edge of the asphalt mat which the paver is laying. Receiver 402A is interfaced with onboard Computer/CPU 403. Computer/CPU 403 contains software, such as Pathfinder Officer™, commercially available from 'Trimble Navigation Limited', for data collection and recording the defined edge of the paver path of this intended mat edge.

The storage and transfer of this defined edge information can be handled in multiple ways. First, this data could be stored to a removable media, such as magnetic floppy disk, optical compact disk, or any other data storage device. This device is then removed from the paver's Computer/CPU 403 and transferred by hand, along physical path 409 to edge roller's Computer/CPU 406.

As secondary means, and more preferred, of getting this data from the paver to the edge roller is to change the digital defined edge information to a media which can be broadcast, (via broadcast signal 410, be it UHF, VHF, FM, satellite, or cellular) using Broadcast System 404, in real time to Receiver System 405, located on the Asphalt Edge Roller. This data is then transferred to Computer/CPU 406 on the Asphalt Edge Roller.

Regardless of the means of transfer, the defined edge of the paver's intended finished edge, in now stored in the Asphalt Edge Roller's onboard computer 406.

DGPS receiver 402B, is positioned on the Asphalt Edge Roller in a location as to indicate the confinement edge face of edge confinement roller 250, and is interfaced with an onboard Computer/CPU 406. Computer/CPU 406 is programmed so as to correlate the data received from its onboard DGPS receiver 402B, with that of the paver's defined edge, and align or position the Asphalt Edge Roller to that of the paver.

We now have the means of controlling two (2) functions on the asphalt edge roller.

First, outputs from Computer/CPU 406 are connected to electronic hydraulic or pneumatic valves, or other systems, to activate the appropriate solenoid for automatic steering control 407A. These outputs would be programmed so as to steer the asphalt edge roller in order to maintain a certain distance or range of distance from this edge. This same automatic steering system can be used on rollers having a fixed edge confinement apparatus similar to the Hamm or Bomag systems.

Figure 4B:
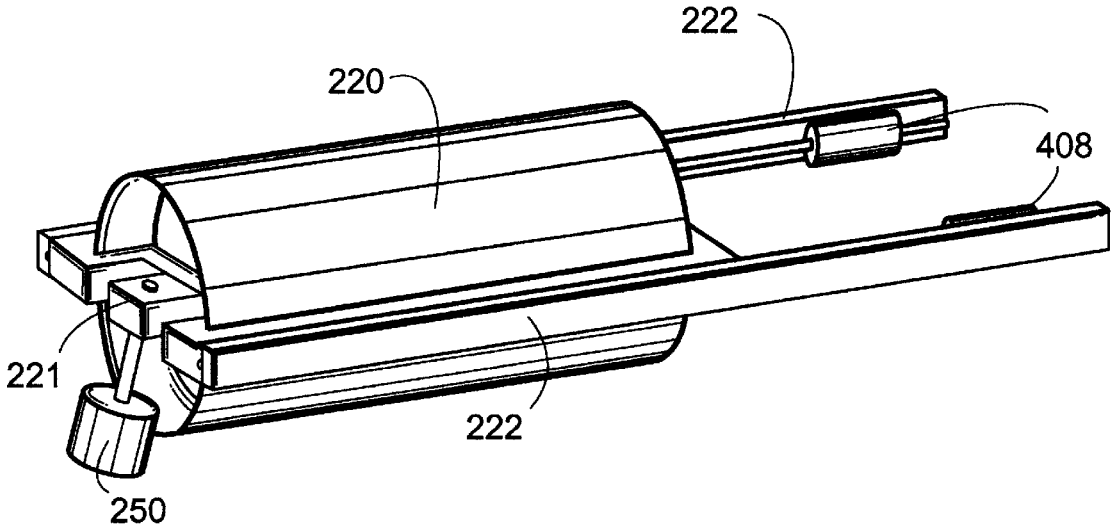
FIG. 4B is a 3-dimensional view of the mechanics for automatic side shift control of horizontal roller 220.
Figure 4C:
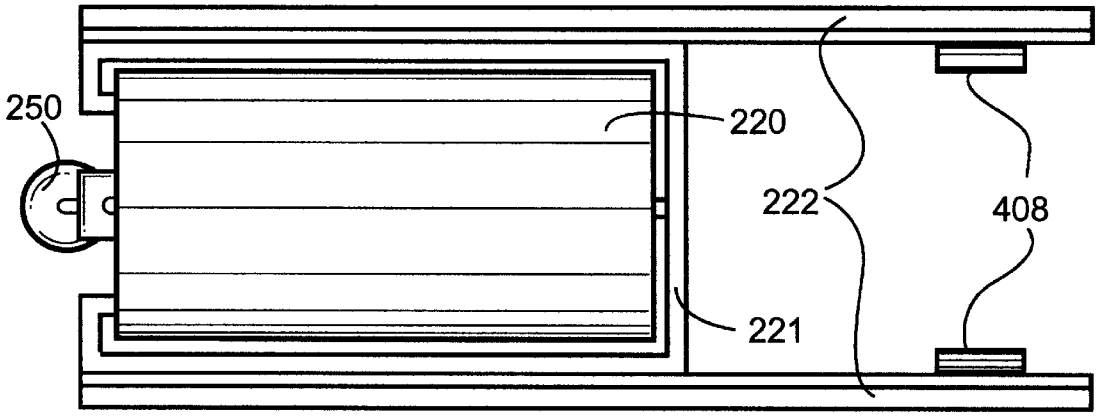
FIG. 4C is a top view of the mechanics for automatic side shift control of horizontal roller 220.

Second, in FIG. 4B & FIG. 4C, outputs from Computer/CPU 406 are connected to electronic hydraulic or pneumatic valves, or other systems, to activate the appropriate solenoid for automatic side shift control 407B. These activation's will operate linear actuators (such as rotating ball screw motors 408) so as to shift horizontal roller 220 along guides 222. These outputs will be programmed so as to position edge confinement roller 250 to travel along the intended finished edge (i.e. defined edge). This action will give horizontal roller 220 its automatic side shift capability.

This GPS and DGPS based steering mechanism as described herein could be used on other equipment applications, such as buses, road equipment, transportation vehicles, trucks, golf carts, or other types of equipment.

Figure 5:
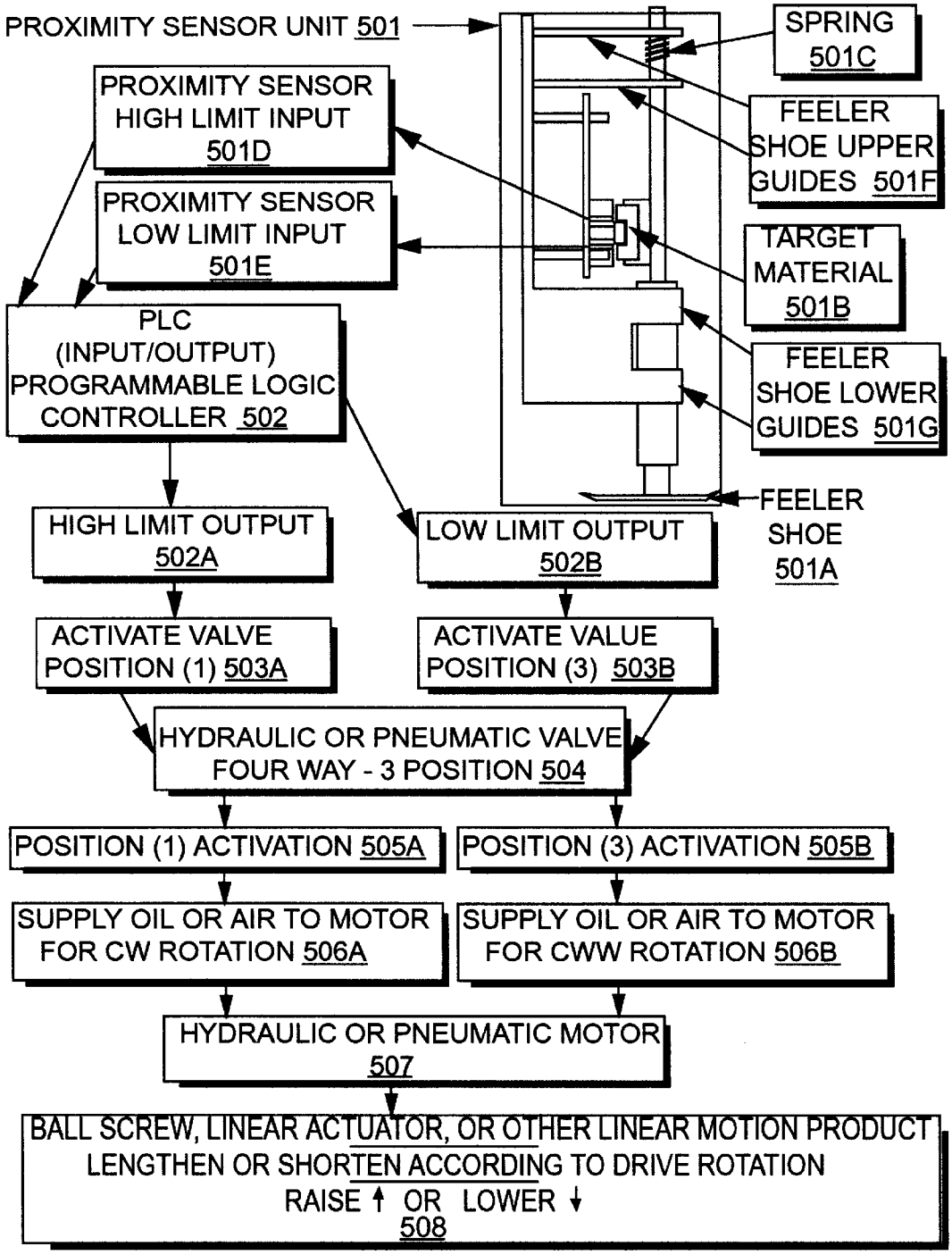
FIG. 5 is a schematic illustration showing the operation of the proximity sensor units 501.
Figure 5A:
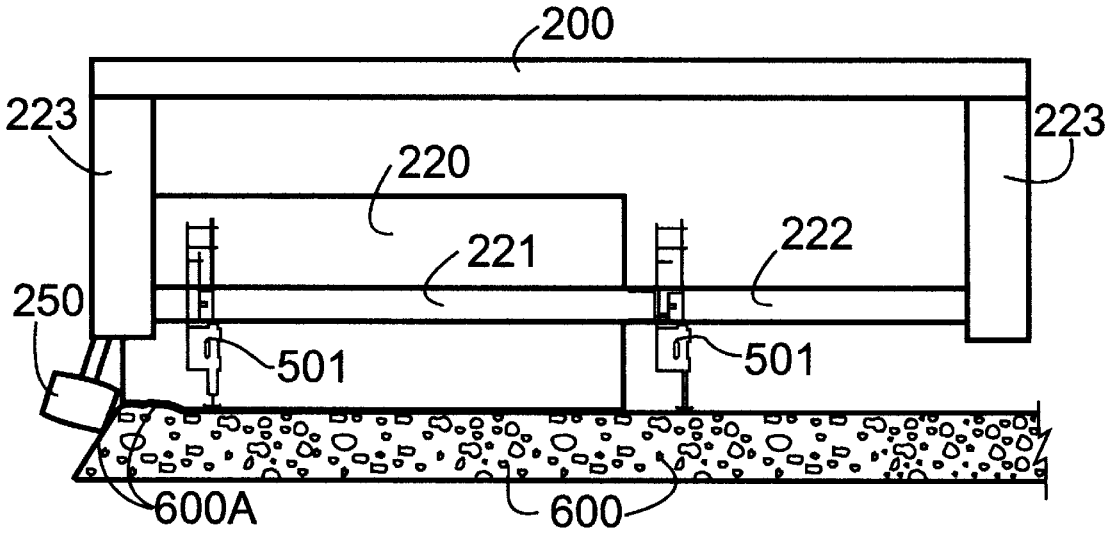
FIG. 5A illustrates the location and function of proximity sensors 501. This view shows the portion of asphalt concrete 600 not yet rolled by horizontal roller 220 and edge confinement roller 250.
Figure 5B:
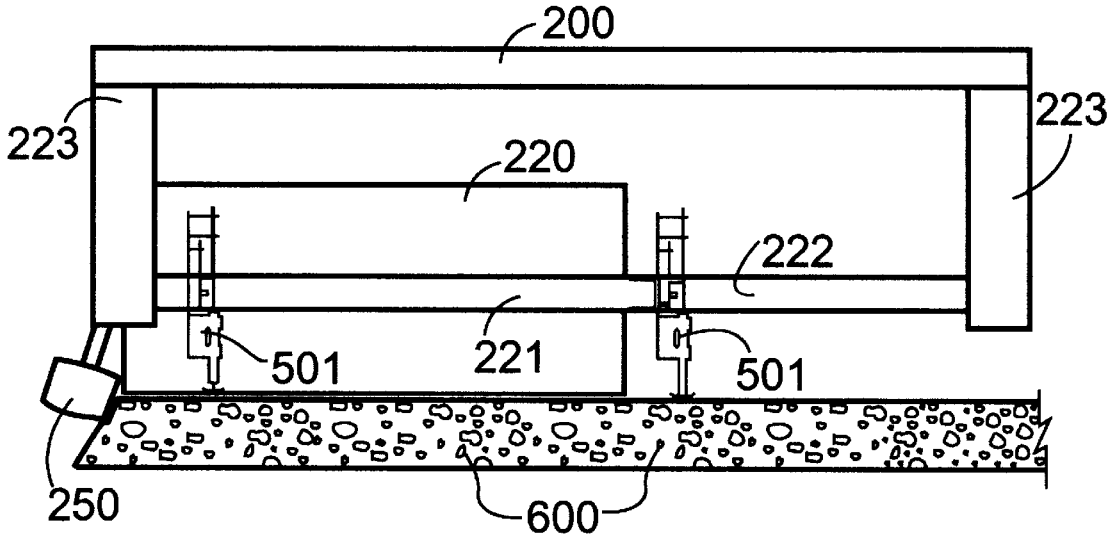
FIG. 5B illustrates the location and function of proximity sensors 501. This view shows the completed compaction of asphalt concrete 600 after rolling by horizontal roller 220 and edge confinement roller 250.

FIG. 5 illustrates, in flowchart form, the operations performed for horizontal placement of horizontal roller 220 of the roller apparatus. In FIG. 5A & FIG. 5B, Proximity sensing units 501, (positioned near each end of horizontal roller 220) are used to monitor the position of the existing rolled asphalt concrete 600 . There are three sensor units 501, (see FIG. 2C). The sensor unit 501 which is positioned in line with the axle at the end of horizontal roller 220, is used for either direction of travel. As for the other two sensor units 501, only the unit on the leading side of horizontal roller 220 is used, depending on the direction of travel. The existing asphalt concrete 600, is that portion of the asphalt pass that has been finish compacted to within 8" to 12", more or less, of the non-contained edge.

Unit 501 comprises: a feeler shoe 501A, target material 501B, spring loading for unit 501C, proximity sensor for high limit 501D, proximity sensor for low limit 501E, feeler shoe upper guides 501F, and feeler shoe lower guides 501G. Parts 501A, (feeler shoe), 501B, (target material w/holder), and 501C, (spring loaded upper shaft), are all parts of a single component. This component is capable of moving up or down in relation to the rest of unit 501. Proximity sensors 501D and 501E are mounted on the stationary portion of unit 501, as are upper guides 501F, and lower guides 501G. 501F & 501G are used to guide the movable portion of unit 501.

Feeler shoe 501A rides along the existing rolled portion of asphalt concrete 600 . Spring 501C is used to apply down pressure between the movable portion of unit 501 and upper guide 501F. This insures continuous contact of feeler shoe 501A with asphalt concrete 600 .

Proximity sensors 501D and 501E are spaced to allow target material 501B to be located within their gap. Target material 501B is preferably a ferrous material. As feeler shoe 501A rides up and down along the existing asphalt concrete 600 upper surface, target material 501B moves up and down in relationship to stationary sensors 501D and 501E. When the target travels toward the high-frequency magnetic fields generated by the sensing coils in the sensors, an induction current (eddy current) is created on the target which increases the impedance of the coil and finally causes oscillation to stop, thereby signaling target detection.

Proximity sensors 501D and 501E are connected to Programmable Logic Controller (PLC) 502. PLC 502 can be programmed so as to perform any output response to the input signals as is desired. In the present application, PLC 502 will be programmed as follows: High limit Output 502A ON, in response to High limit Input 501D trigger. Low limit Output 502B ON, in response to Low limit Input 501E trigger.

A High limit Output 502A will activate position (1) solenoid 503A on four way—3 position valve 504. A Low limit Output 502B will activate position (3) solenoid 503B on four way—3 position valve 504.

With a position (1) activation 505A of valve 504, supply fluid (oil or air) 506A will be fed to motors 507 for clockwise rotation. With a position (3) activation 505B of valve 504, supply fluid (oil or air) 506B will be fed to motors 507 for counterclockwise rotation.

Dependent on the direction of rotation of motors 507, the linear motion apparatus 508, (ball screw, linear actuator, or other) will lengthen or shorten. This will raise or lower a respective end of horizontal roller 220. This will assure that horizontal roller 220 will remain in the same plane as the existing rolled asphalt concrete 600 .

FIG. 5A & FIG. 5B illustrate a before & after view, respectively, of the compaction of asphalt concrete 600. In FIG. 5A, sensing units 501, near each end of horizontal roller 220, monitor the position of existing rolled asphalt concrete 600. The portion 600A of asphalt concrete 600 not yet rolled will consist of the substantially vertical edge surface and 8" to 12", more or less, of the adjacent horizontal surface. In FIG. 5B, the positioning of horizontal roller 220, by means of sensors 501, allows for the unrolled horizontal portion of asphalt concrete 600, (600A shown in FIG. 5A), to be rolled and compacted as to maintain the same planarity as the balance of asphalt concrete 600. The compaction of the substantially vertical edge surface is achieved by means of the automatic side shift control of edge confinement roller 250 horizontally.

Any of the above mentioned automatic steering systems could also be used in conjunction with conventional rollers having a fixed edge confinement apparatus similar to the Hamm or Bomag devices previously discussed. By use of automatic steering of the carrier vehicle, the fixed edge confinement apparatus would then have the capability to achieve and maintain the desired density. By doing so, these fixed edge confinement apparatus rollers will then become an edge force which is longitudinally mobile and horizontally translatable. This will make these fixed edge confinement apparatus rollers suitable for use in accordance with our method patent, U. S. Pat. No. 5,336,019.

Other variants are possible without departing from the scope of this invention.

What is claimed is:

1. A method for controlling the steering of a carrier vehicle of the type having a horizontal cylindrical compacting roller and a substantially-vertical side edge confinement force means for compacting an asphalt concrete lane laid down by a paving machine, wherein the paving machine follows a predetermined path and the asphalt concrete lane includes a defined edge which varies from said predetermined path, the method comprising the steps of:

(a) providing position information of the exact location of said defined edge;

(b) providing control means, responsive to said position information, for steering said carrier vehicle so that said compacting roller and said side edge confinement force means follow the position of said defined edge and compact said asphalt concrete lane to provide uniform density.

2. A method in accordance with claim 1, wherein said position information comprises latitude, longitude, and elevation information.

3. A method in accordance with claim 2, wherein said latitude, longitude and elevation information is provided by a differential global positioning system.

4. A method for controlling side edge confinement force applied to a defined edge of an asphalt concrete lane by a compacting vehicle of the type including (a) a horizontal cylindrical compacting roller having a first end, and (b) substantially vertical side edge confinement force means carried by said compacting roller and extending downwardly below and adjacent to said first end of said compacting roller, wherein said asphalt concrete lane has been laid down by a paving machine following a predetermined path, wherein the position of said defined edge of the asphalt concrete lane varies from said predetermined path, the method comprising the steps of:

(a) providing position information of the exact location of said defined edge;

(b) providing linear actuator means, responsive to said position information, for moving said horizontal compacting roller axially so that said compacting roller and said side edge confinement force means follow the position of said defined edge.

5. Apparatus for controlling the steering for a carrier vehicle of the type having horizontal cylindrical compacting roller and a substantially-vertical side edge confinement force means for compacting an asphalt concrete lane laid down by a paving machine, wherein the paving machine follows a predetermined path and the asphalt concrete lane includes a defined edge which varies from said predetermined path, the apparatus comprising:

(a) sensor means on said carrier vehicle for sensing the position of said defined edge; and (b) control means for steering said carrier vehicle so that said compacting roller and said edge confinement force means follow the position of said defined edge and compact said asphalt concrete lane to provide uniform density.

6. Apparatus in accordance with claim 5, wherein said sensor means is selected from the group consisting of photoelectric, magnetic, infrared, laser and fiber optic sensors.

7. Apparatus in accordance with claim 6, wherein said sensor means comprises a camera capable of displaying the location of marker means adjacent to said carrier vehicle.

8. Apparatus in accordance with claim 6, wherein said control means comprises steering means operable by the operator of said vehicle for steering said vehicle to maintain the position of said side edge confinement force means in desired relation to said defined edge.

9. Apparatus in accordance with claim 6, wherein said control means comprises electronic control means for steering said vehicle left or right as necessary to maintain said edge confinement force means adjacent to said defined edge.

10. Apparatus in accordance with claim 6, wherein said sensor means comprises an array of lasers for determining the position of said defined edge.

11. Apparatus in accordance with claim 5, wherein said horizontal roller includes a first end, wherein said edge confinement force means comprise a substantially-vertical roller carried by said horizontal roller, and wherein said vertical roller extends below, and is adjacent to, said first end of said horizontal roller.

12. Apparatus in accordance with claim 11, wherein said horizontal roller is horizontally translatable relative to said carrier vehicle.

13. Apparatus for controlling the steering of a carrier vehicle of the type having a horizontal cylindrical compacting roller and a substantially-vertical side edge confinement force means for compacting an asphalt concrete lane laid down by a paving machine, wherein the paving machine follows a predemtermined path and the asphalt concrete lane includes a defined edge which varies from said predetermined path, the apparatus comprising:

(a) means for receiving position information of the location of said defined edge;

(b) control means, responsive to said position information, for steering said carrier vehicle so that said compacting roller and said side edge confinement force means follow the position of said defined edge and compact said asphalt concrete lane to provide uniform density.

14. Apparatus in accordance with claim 13, wherein said position information comprises latitude, longitude, and elevation information.

15. Apparatus in accordance with claim 14, wherein said latitude, longitude and elevation information is provided-by a differential global positioning system.

16. A method for compacting a given amount of asphalt concrete in an area defined by a lane to obtain uniform density in said lane, wherein said lane has been laid down by a paving machine following a predetermined path, and wherein said sane includes a defined edge which varies from said predetermined path, the method comprising the steps of:

(a) providing a compacting vehicle including a substantially vertical side edge confinement force means;

(b) providing sensor means on said compacting vehicle for sensing the position of said defined edge; and (c) controlling the steering of said compacting vehicle so that said edge confinement force means follows the exact path of said defined edge.

17. A method for obtaining uniform density of an asphalt concrete lane laid down by a paving machine, wherein the paving machine follows a predetermined path and the asphalt concrete lane includes a defined edge which varies from said predetermined path, the method comprising the steps of:

(a) sensing the position of said defined edge of said lane;

(b) compacting said asphalt concrete lane with a carrier vehicle comprising a horizontal cylindrical compacting roller and a substantially vertical side edge confinement force means; and, simultaneously, (c) controlling the steering of said carrier vehicle so that said compacting roller and said side edge confinement force means follow the position of said defined edge, regardless of the position of said predetermined path, and compact said asphalt concrete lane to provide uniform density.

18. A method in accordance with claim 17, wherein said horizontal roller includes a first end, wherein said edge confinement force means comprise a substantially-vertical roller carried by said horizontal roller, and wherein said vertical roller extends below, and is adjacent to, said first end of said horizontal roller.

19. A method in accordance with claim 17, wherein the position of said defined edge is sensed by sensor means selected from the group consisting of photoelectric, magnetic, infrared, laser and fiber optic sensors.

20. A method in accordance with claim 19, further comprising the step of positioning marker means parallel to said defined edge and at an equal distance from said defined edge at all points, and wherein said sensor means is adapted to sense the position of said marker means.

21. A method in accordance with claim 20, wherein the steering of said vehicle is controlled by electronic control means capable of steering said vehicle left or right as necessary to position said side edge confinement force means in contact with said defined edge of said lane.

22. A method in accordance with claim 20, wherein said sensor means comprises a camera capable of displaying the exact location of said marker means.

23. A method in accordance with claim 22, wherein the steering of said vehicle is controlled by an operator, viewing a display of said marker means from said camera, to maintain the position of said side edge confinement force means in desired relation to said defined edge.

24. A method in accordance with claim 19, wherein said sensor means comprises an array of lasers for determining the position of said defined edge.

25. A method in accordance with claim 24, wherein said horizontal cylindrical compacting roller having first and second ends carried by a carrier vehicle.

* * * * *